US005085154A

United States Patent [19]

Merl

[11] Patent Number: 5,085,154

[45] Date of Patent: Feb. 4, 1992

[54] EXPANDABLE TRAY ASSEMBLY

[75] Inventor: Milton Merl, New York, N.Y.

[73] Assignee: Marlboro Marketing, Inc., New York, N.Y.

[21] Appl. No.: 354,904

[22] Filed: May 19, 1989

[51] Int. Cl.[5] ..... A47B 13/08

[52] U.S. Cl. ..... 108/90; 108/61; 211/184

[58] Field of Search ..... 108/90, 93, 97, 73, 108/143, 60, 61, 102; 211/94, 153, 184, 126, 162

[56] References Cited

U.S. PATENT DOCUMENTS

| | | | |
|---|---|---|---|
| 1,524,767 | 2/1925 | Vandervoort | 108/90 X |
| 2,891,679 | 6/1959 | Maupin | 108/93 |
| 2,937,765 | 5/1960 | Shank | 108/143 |
| 3,138,262 | 6/1964 | Anders | 108/60 X |
| 3,919,949 | 11/1975 | Rendleman | 108/143 X |
| 4,488,653 | 12/1984 | Belokin | 211/184 |
| 4,602,570 | 7/1986 | Lee | 108/143 X |
| 4,658,969 | 4/1987 | Mastrodicasa | 211/153 X |
| 4,705,175 | 11/1987 | Howard et al. | 211/126 X |
| 4,830,201 | 5/1989 | Breslow | 211/184 |
| 4,907,707 | 3/1990 | Crum | 211/59.3 |

*Primary Examiner*—Jose V. Chen
*Attorney, Agent, or Firm*—Darby & Darby

[57] ABSTRACT

An expandable item carrying tray assembly adapted to be supported on a shelf is provided. The tray assembly includes at least one track and a mechanism for mounting the at least one track to the shelf so that the track is fixed longitudinally with respect to the shelf. The tray assembly also includes a tray member for carrying items thereon which is moveably secured to the track and is moveable in a lateral direction with respect to the track and the shelf. The tray member is releasably lockable in at least two positions with respect to the track. The tray assembly is both convenient to use and provides an aesthetically pleasing and eye-catching appearance to a consumer.

11 Claims, 5 Drawing Sheets

EXPANDABLE TRAY ASSEMBLY

FIELD OF THE INVENTION

The invention relates generally to expandable tray assemblies and, in particular, to a tray assembly which expands to increase the depth of an existing shelf on which the assembly is secured.

BACKGROUND OF THE INVENTION

Shelves for carrying items are a natural feature of consumer goods stores, such as grocery stores, drug stores and the like. Such shelves are constructed of plastic, metal or other suitable material and are generally designed to be as functional as possible even in the absence of aesthetically pleasing or eye-catching features. These shelves are usually of a fixed depth and therefore, carry a predetermined maximum number of items in the space from the front to the back of the shelf. The predetermined maximum number of items depends, of course, on the size of that item.

One disadvantage of shelves of this type is that the predetermined maximum number of items can not easily be changed for any given item and it is not possible to carry additional items on the space allotted for that item on the shelf even at the time of a promotional effort for that item. Consequently, a heavily promoted item can quickly appear to be out of stock.

Another disadvantage of this type of functional shelf is that items are not displayed in an aesthetically pleasing or eye-catching manner. Each store has row upon row of the same type of functional shelves and there are rarely any distinguishing features to attract a customer to a particular item or display.

SUMMARY OF THE INVENTION

In order to overcome the disadvantages of prior art store shelves, an expandable item-carrying tray assembly adapted to be forwardly and backwardly slideable when supported on an existing longitudinal shelf is provided. The assembly includes at least one track extending traversely to the shelf and a tray member for carrying items which is slideably secured to the track. Means for mounting the track to the existing shelf are also provided so that the track remains fixed with respect to the shelf while the tray member can be moved along the track traversely to the shelf. The tray can be moved from a first position in which it corresponds in depth substantially to the shelf, in the event that the item being carried is not being promoted heavily, to a second position in which a front portion of the tray extends past the front edge of the shelf, for example, in the event of a promotion of the products on the tray. Locking means for releasably locking the tray in the first and second positions are also provided. The tray both increases the carrying capacity of the shelf and in addition, when shifted to the second, i.e. extended, position thereof provides an eye-catching display to a customer.

DETAILED DESCRIPTION OF THE PREFERRED EMBODIMENTS

An expandable tray assembly 10 is provided for use on an ordinary store shelf 12. The tray assembly 10 includes an item carrying tray member 16, at least one track 14 for cooperating with tray member 16 for guiding the tray and means for mounting the track 14 transversely to the shelf 12 so that the entire tray assembly 10 is secured to the shelf 12. Tray member 16 is moveably secured to the track 14 so as to be slideable along track 14 in a lateral direction with respect to the longitudinal shelf 12.

Figure 1:
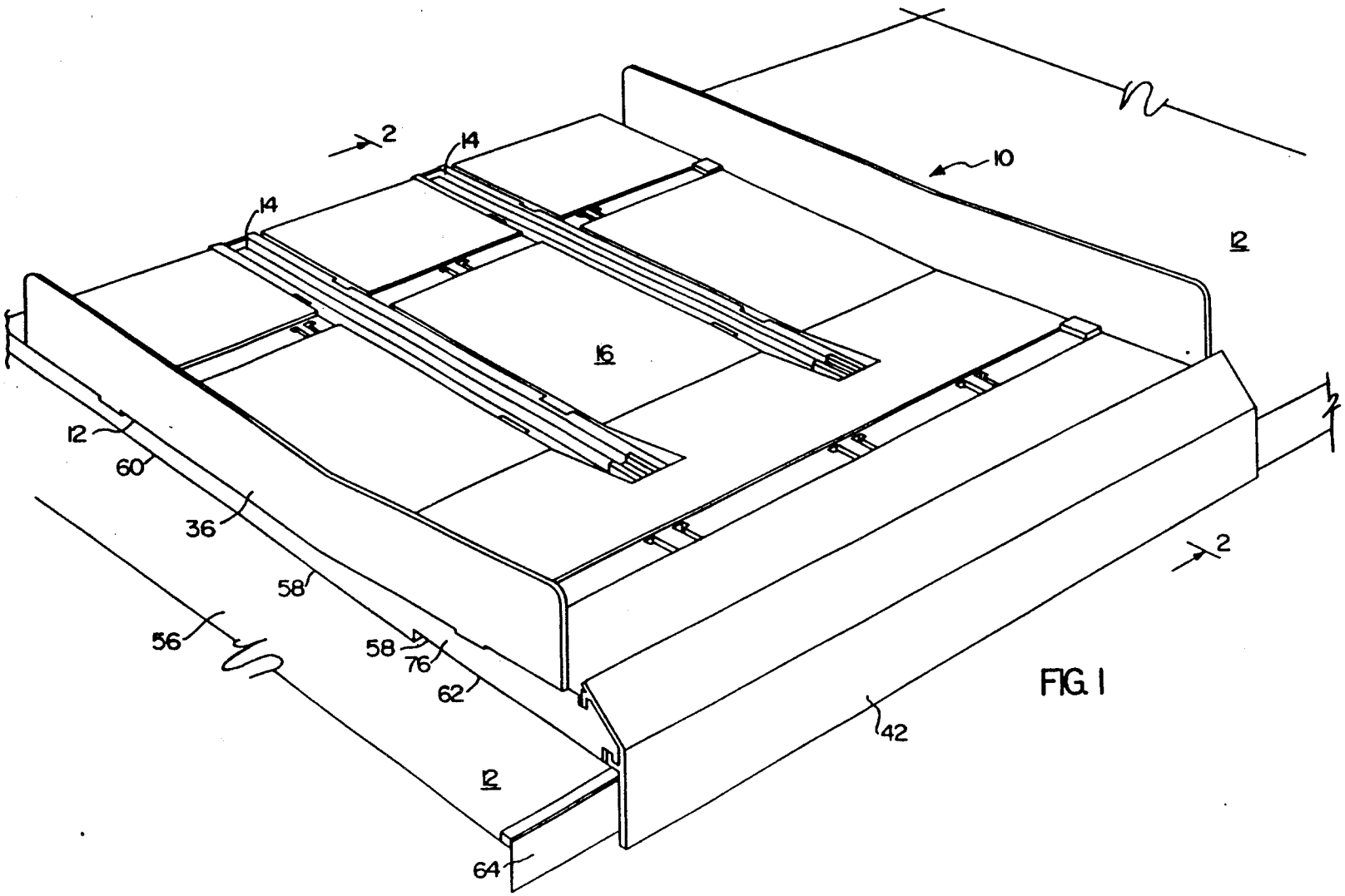
FIG. 1 is a perspective view of an expandable tray assembly constructed and arranged in accordance with the invention.
Figure 2:
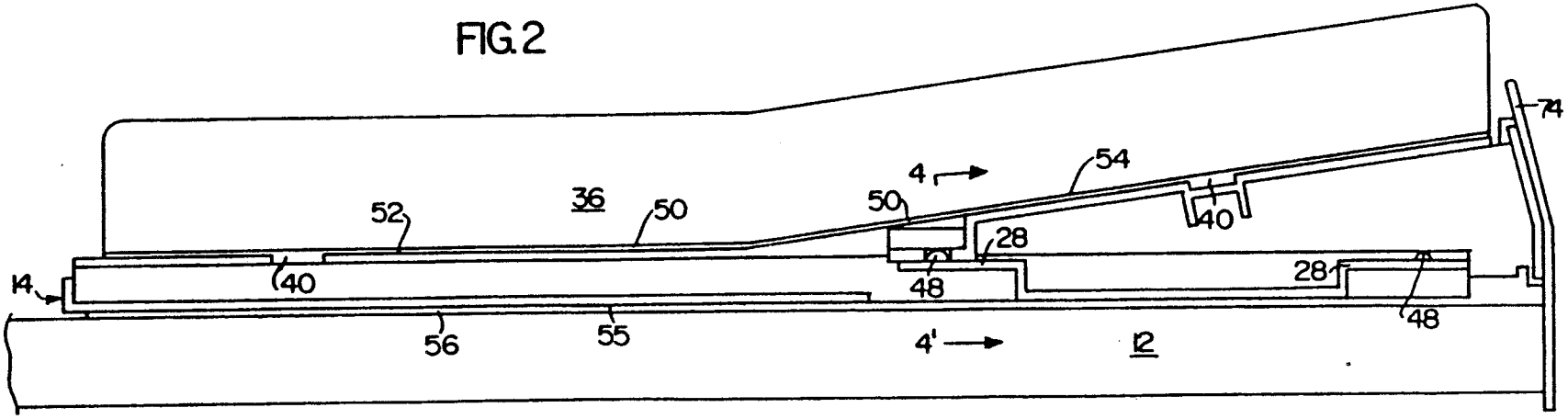
FIG. 2 is a sectional view of the tray assembly taken along section line 2—2 of FIG. 1.
Figure 3:
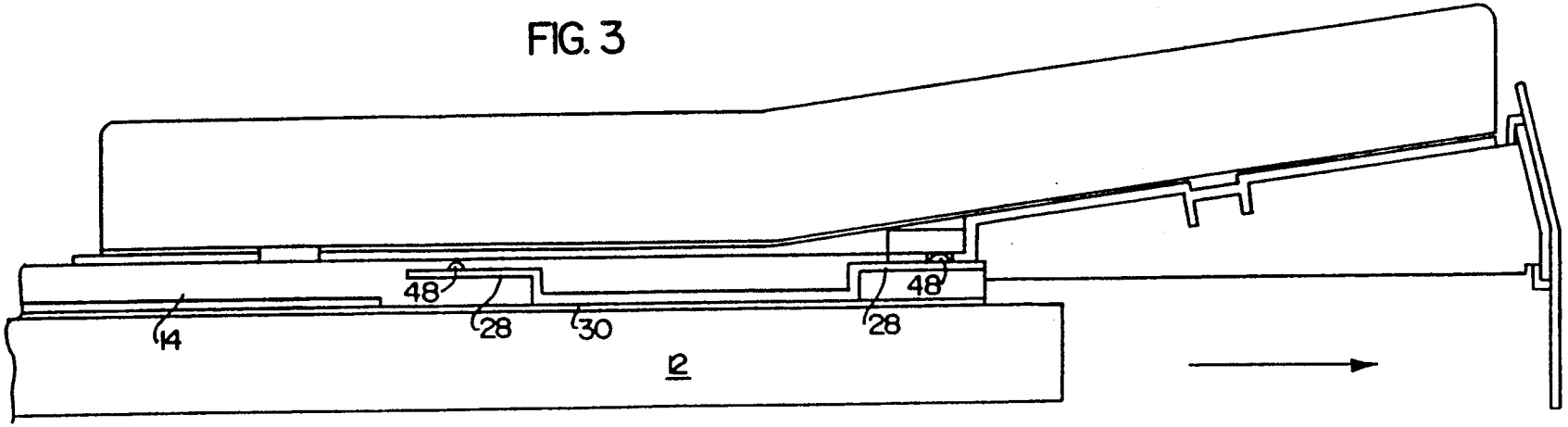
FIG. 3 is a sectional view similar to FIG. 2 except that the tray assembly is shown in an expanded condition.
Figures 4, 5:
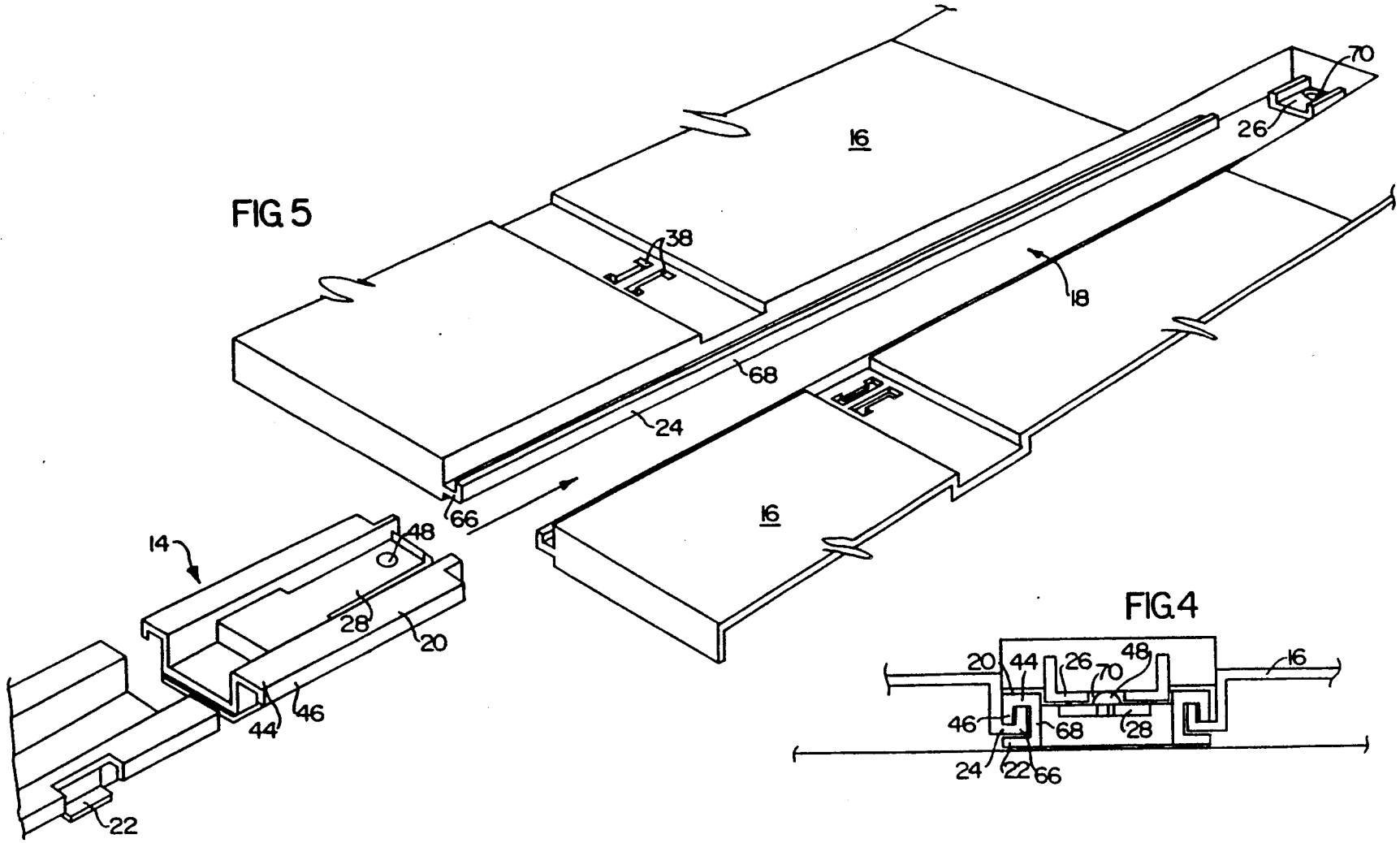
FIG. 4 is a enlarged sectional view taken along section line 4—4 of FIG. 2.
FIG. 5 is an exploded perspective view partially in section of the tray assembly showing a means for moveably securing the tray to a track.
Figure 6:
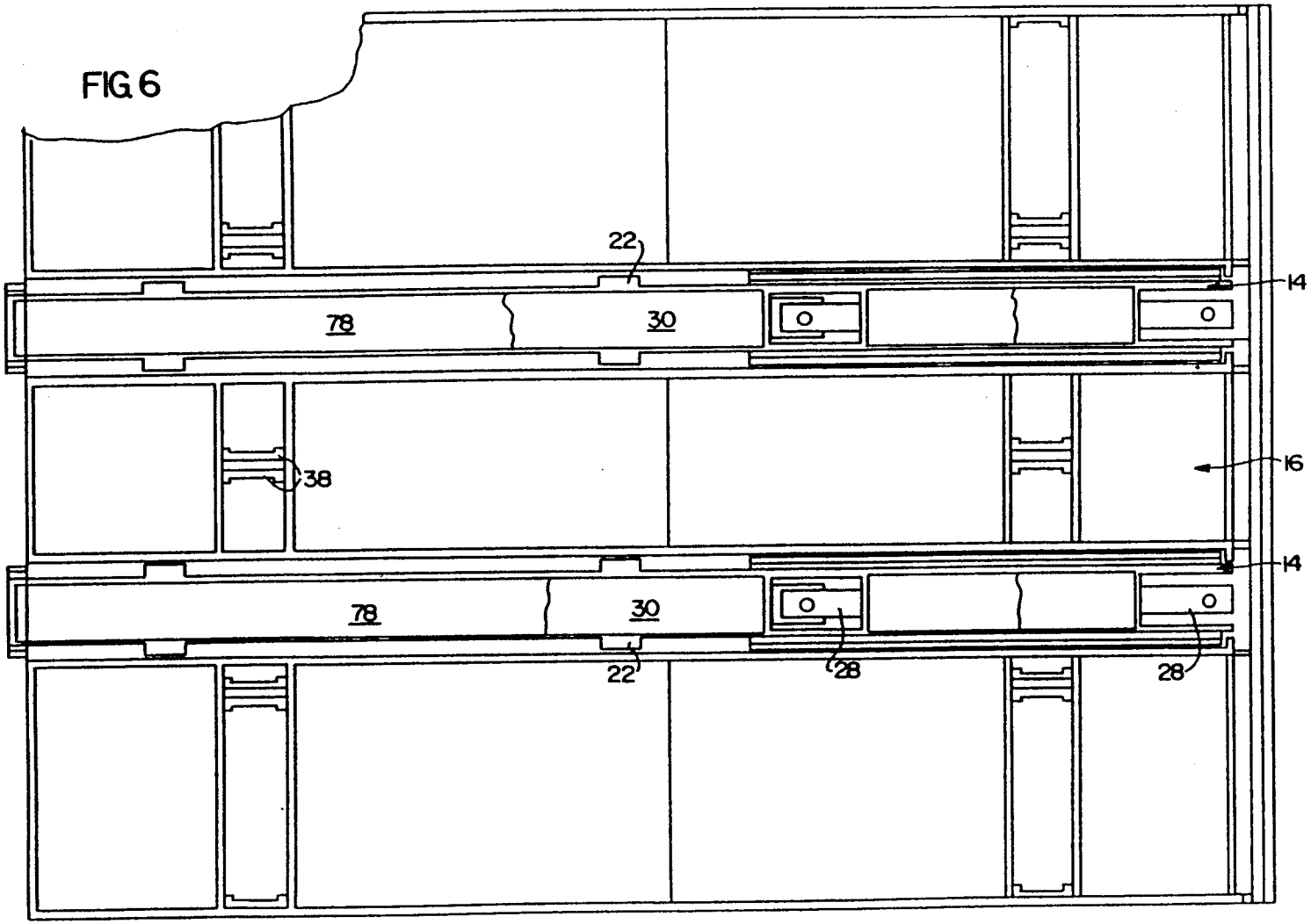
FIG. 6 is a bottom plan view of the tray assembly.
Figure 7:
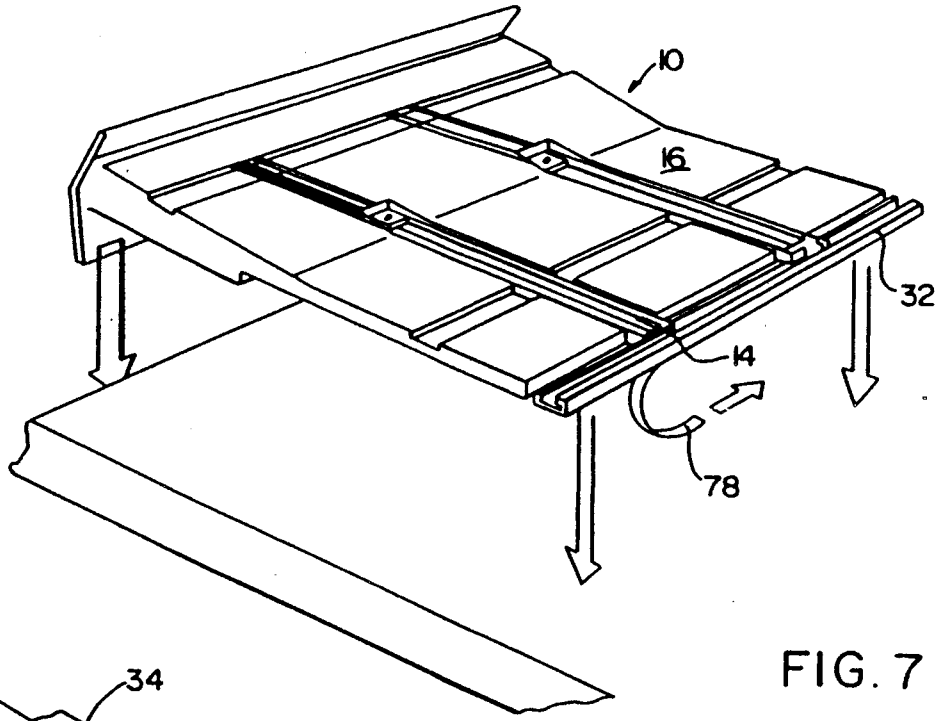
FIG. 7 is a perspective view showing an alternate means for mounting the track to a shelf.
Figure 8:
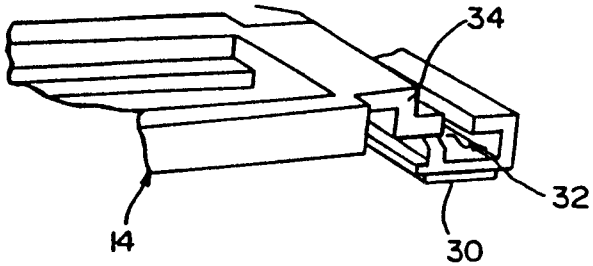
FIG. 8 is a exploded view showing the connection between a track guide 32 and a track 14.

In a preferred embodiment, two tracks 14 are provided. Each of the tracks 14 has a pair of elongated downwardly open grooved portions 20 at opposite elongated edges thereof adapted to slidingly engage a corresponding pair of upwardly open grooved portions 24 extending at opposite elongated edges of a lateral slot 18 in the base plate 50 of the tray member 16. The tracks 14 form guide means which include a pair of opposite facing guide members each having a generally C-shaped cross-section. The C-shaped cross-section has an upper horizontal portion 20 and a lower horizontal portion 22 positioned so as to receive a cooperating rail 24 (See FIG. 4) which projects from the tray member 16 therebetween. The upper and lower portions 20 and 22 may be of any suitable shape so long as sufficient space is provided for receiving and guiding the cooperating rail 24. In a preferred embodiment, the upper portion 20 is continuous and has a downwardly extending lip 46. In contrast, the lower portion 22 is in the form of a plurality of short flat tabs spaced at intervals along the underside of the track 14 which is to be fixed to the shelf 12.

The track 14 also preferably includes a means for locking the tray member 16 which is moveable therealong in at least two different fixed positions with respect to the track 14. In a preferred embodiment, the locking means includes a tab engagement member 28 having an upwardly extending protrusion 48 thereon. In an especially preferred embodiment, two tab engagement members 28 at two different positions along the length of the track 14 are provided. This permits the tray member 16 to be locked in a first position in which it corresponds in depth substantially to the shelf 12 or in a second position in which the front portion of the tray member 16 extends past the front edge of the shelf 12. It is, of course, to be understood that the tab engagement member 28 and the upwardly extending protrusion 48 may take any suitable shape so long as cooperation with the tray member 16 to lock the member 16 in predetermined fixed positions with respect to the track 14 is assured.

Means for mounting the track in a fixed relationship with respect to the shelf 12 are also provided. In one preferred embodiment, the track mounting means is an adhesive 30. The adhesive 30 may be provided as an adhesive strip or as discreet pieces of double-sided adhesive tape. The tape is secured to the track 14 on the underside 55 of the track 14 which is to be adhered to the upper surface 56 of the shelf 12. A piece of protective paper or foil 78 can be provided on the tape and removed immediately prior to securing the track 14 to the shelf 12.

In an alternate embodiment, the track mounting means includes a rear extrusion or track guide 32 which is fixedly mounted to the shelf 12 and a snap mechanism 34 provided on the end of each track 14. The shelf 12 has a front edge 11 and a rear edge 13 and the track guide 32 is mounted parallel to the edges 11 and 13 at a position adjacent the rear edge 13. The snap mechanism 34 couples the track 14 to the track guide 32 so that the track 14 extends transversely with respect to the track guide 32 and the shelf 12. The track guide 32 includes an adhesive or other suitable means for mounting the track guide 32 to the shelf 12. The track guide 32 and the snap mechanism 34 are cooperatively constructed so that they do not uncouple even when the tray member 16 is moved laterally with respect to the track 14 and the shelf 12.

A tray member 16 for carrying items is movably secured to the at least one track 14. The tray member 16 preferably includes a lateral slot 18 adapted to receive the at least one track 14 therewithin. Each lateral slot 18 is only slightly larger than the width of the elongated track 14. At least one rail 24 projects into the lateral slot 18 so as to be received between the upper horizontal portion 20 and lower horizontal portion 22 of the guide means. In a preferred embodiment, rail 24 has an upwardly extending lip 68. A horizontal section 66 of rail 24 is under downwardly extending lip 46 of upper guide member 20 and vertically extending lip 68 of rail 24 is under horizontal portion 44 of upper guide member 20. By permitting the upper horizontal portion 20 and the lower horizontal portion of the guide means 22 and rail 24 to cooperate in this manner, free lateral movement of the tray member 16 along track 14 is assured.

The item carrying surface 50 of the tray member 16 includes a substantially flat portion 52 and an upwardly sloped portion 54. Substantially flat portion 52 is provided so as to be parallel to the upper surface 56 of shelf 12. Upwardly sloped portion 54 slopes at an angle between about 5° and 30° degrees with respect to substantially flat portion 52, preferably between about 10° and 25° degrees. The purpose of providing the upwardly sloped portion 54 is to ensure that items carried on item carrying surface 50 of the tray member 16 remain on the tray member 16 and do not fall forward onto the floor as items are removed. This counteracts the natural tendency of the items to move in the direction in which they are being pulled. Specifically, when an item is removed from the item carrying surface 50 the remaining items have a natural tendency to fall forward. In addition, the upward slope assists in providing an aesthetic or eye-catching appeal to the items carried on base 16. This is particularly useful when the tray assembly 10 is used on a shelf 12 that is lower than eye-level so that a consumer is looking down at the items carried on the item carrying surface 50.

The underside 58 of the tray member 16 which is the side nearest upper surface 56 of shelf 12, includes a weight bearing portion 60 and a recessed portion 62. Weight bearing portion 60 is provided substantially underneath the flat portion 52 of the tray member 16. Most of the weight of the tray member 16 is carried on the weight bearing portion 60. The reason for providing the recessed portion 62 is that most store shelves 12 include a shelf ticket channel 64 which extends slightly upward of upper surface 56 of shelf 12. It is, therefore, necessary for the underside 58 of the tray member 16 to be capable of moving laterally with respect to the shelf ticket channel 64 and in fact, the recessed portion 62 of the underside 58 of the tray member 16 is generally supported by the shelf ticket channel 64.

The tray member 16 also preferably includes a lock tab 26 which extends into the channel 18 in a position above the track 14. The lock tabs 26 are provided with an opening 70 therethrough for receiving the upwardly extending protrusion 48 on the tab engagement member 28 of the track 14. This permits the tray member 16 to be locked into defined positions with respect to the track 14. The lock tabs 26 should be constructed of a resilient material so that they can be lifted in order to release the upwardly extending protrusion 48 and unlock the tray member 16 from the track 14.

The tray member 16 also preferably includes a plurality of holes 38 which are aligned so as to receive a divider 36 therein. The lower edge 72 of the divider 36 conforms substantially to the upper surface 56 of shelf 12 and has a plurality of pins or C-clips 40 which extend downwardly therefrom so as to be received in the holes 38 to removeably secure the divider 36 to the tray member 16. The dividers 36 serve the function of separating items carried on the item carrying tray 10. In an alternate embodiment, the dividers are formed integrally with the tray member and are not removable.

As an additional feature, the tray member 16 can also be provided with a means of displaying a graphic label 42. The graphic label display means 42 can be either permanently secured to the tray member 16 or removeable therefrom by a snap mechanism, a sliding mechanism or the like. An upwardly extending edge 74 of the graphic display means 42 can, of course, be used to maintain items on the item carrying tray 10. A graphic label is removeable and replaceable within the graphic display means 42.

Additionally, means may be provided along a side edge 76 of the tray member 16 for securing the tray 10 to an immediately adjoining tray 10 and thereby providing a dovetailing capability between immediately adjoining trays 10 on a shelf 12.

In use, each of tracks 14 is slid all the way into the lateral slots 18 of the tray member 16 so that the rail 24 on the tray member 16 is maintained between the upper horizontal portion 20 and the lower horizontal portion 22 of the guide means. In this position, the opening 70 in the lock tab 26 on the tray member 16 engages an upwardly extending protrusion 48 on a tab engagement member 28 of the track 14. Accordingly, the tray member 16 is now locked with respect to the track 14 and can be handled as a completed assembly 10.

With the tray member 16 in this locked position with respect to the track 14, the track 14 is secured to the shelf 12 so as to extend transversely with respect to the shelf 12. If an adhesive 30 is provided on the underside 55 of the track 14, the track 14 and tray member 16 are simply pressed downward to secure the adhesive 30 to the upper surface 56 of the shelf 12. It is understood that if the adhesive 30 is in the form of double-sided tape, it may be necessary to remove a layer of paper 78 or other protective material from the tape prior to securing the adhesive.

In an alternate embodiment, each of tracks 14 include a snap mechanism 34 at the end thereof and this snap mechanism is adapted to be fitted into a track guide 32 or rear extrusion 32. The tray 10 is completely assembled including the track guide 32 and then the track guide is adhered to the shelf 12 adjacent the rear edge 13 for example, using a suitable adhesive 30 such as double-sided tape. Alternatively, any other suitable adhesive material can be used including, for example, magnetic tape.

In positioning the tray 10 on the shelf 12, it is important to ensure that the front of the tray 10 hangs over the shelf ticket channel 64. Specifically, the shelf ticket channel 64 must be accomodated within the recessed portion 62 on the underside 58 of the tray member 16.

If used, dividers 36 can be fitted into the holes 38 on the top item carrying surface 50 of the tray member 16. Additionally, it must be decided whether item carrying tray 10 is to be maintained in a closed position or opened to an extended position prior to placing items on the item carrying tray 10. If the item carrying tray 10 is to be maintained in a closed position, items can be placed on the item carrying surface 50 of the tray 10 as soon as the tracks 14 have been secured to the shelf 12. Alternatively, if the item carrying tray 10 is to be expanded, the lock tabs 26 are lifted to release the upwardly extending protrusion 48 from engagement with the opening 70 in the lock tab 26. This releases the tray member 16 for lateral movement with respect to the track 14 and the shelf 12. When the tray member 16 is fully extended, the opening 70 in the locked tabs 26 will again engage a second upwardly extending protrusion 48 on a second tab engagement member 78 of track 14. Accordingly, the tray member 16 will remain locked in an extended position with respect to the track 14. In this position, items can be placed and maintained on the item carrying surface 50 of the base 16. Additionally, a graphic label can be displayed in the graphic label display means 42.

As can be seen, a convenient expandable item carrying tray is provided in accordance with the invention. The tray is suitable for expanding the item carrying capacity of a store shelf and is particularly useful, for example, in the event of a promotion of that particular item. It is especially contemplated that the tray be used to carry pre-packaged items, which particularly in Europe, include such things as hosiery and the like. In addition to convenience, the expandable tray is eye-catching and provides excellent aesthetic appeal to a consumer.

What is claimed is:

1. An expandable tray assembly adapted to carry items for sale of display and adapted to be supported on a generally horizontal shelf having a front and a rear longitudinal edge for increasing the effective depth of such shelf so as to allow more items to be carried thereon, comprising:

at least one track;

means for mounting said track on such a horizontal shelf having a front and a rear longitudinal edge so that said track will remain fixed with respect to the shelf and will extend transversely to the front longitudinal edge of the shelf;

a tray member for carrying the display items, said tray member having a front portion and an open rear portion and having means to slidably secure said tray member to said track for sliding movement of said tray member with respect to said track, and relatively toward and away from the rear longitudinal edge of the shelf upon such mounting of said track on the shelf, between a first position in which said front portion of said tray member will be generally aligned with the front longitudinal edge of the shelf and a second position in which said front portion of said tray member will extend forwardly of the front longitudinal edge on the shelf; and locking means for releasably locking said tray member in said two positions thereof.

2. The tray assembly of claim 1 wherein the mounting means includes an adhesive affixed to the at least one track on the side adjacent the corresponding shelf to which it is to be affixed by said adhesive.

3. The tray assembly of claim 2 wherein the adhesive is double-sided adhesive tape.

4. The tray assembly of claim 2 wherein the adhesive is magnetic tape.

5. The tray assembly of to claim 1 wherein the assembly further comprises at least one divider extending upwardly from the tray member for separating items carried on the tray member.

6. The tray assembly of claim 5 wherein the at least one divider is removable from the tray member.

7. An expandable tray assembly adapted to carry items for sale or display and adapted to be supported on a generally horizontal shelf having a front and rear longitudinal edge for increasing the effective depth of such shelf so as to allow more items to be carried thereon, comprising:

at least one track;

means for mounting said track on such a horizontal shelf having a front and a rear longitudinal edge so that said track will remain fixed with respect to the shelf and will extend transversely to the front longitudinal edge of the shelf;

a tray member for carrying the display items, said tray member having a front portion and having means to slidably secure said tray member to said tract for sliding movement of said tray member with respect to said track, and relatively toward and away from the rear longitudinal edge of the shelf upon such mounting of said track on the shelf, between a first position in which said front portion of said tray member will be generally aligned with the front longitudinal edge of the shelf and a second position in which said front portion of said tray member will extend forwardly of the front longitudinal edge of the shelf; and locking means for releasably locking said tray member in said two positions thereof;

wherein the assembly further comprises at least one divider extending upwardly from the tray member for separating items carried on the tray member;

wherein the at least one divider is removable; and wherein the tray member includes means defining a plurality of holes aligned so as to hold the at least one divider and wherein each divider includes a plurality of C-clips extending from the divider on the same side of the divider for cooperating with corresponding holes and positioned for fitting each C-clip into a corresponding hole to hold the divider in an upright position.

8. The tray assembly of claim 1 wherein the tray member further comprises means for displaying a graphic label so that the graphic label can be viewed when items are carried on the tray member.

9. An expandable tray assembly adapted to carry items for sale or display and adapted to be supported on a generally horizontal shelf having a front and a rear longitudinal edge for increasing the effective depth of such shelf so as to allow more items to be carried thereon, comprising:

at least one track;

means for mounting said track on such a horizontal shelf having a front and a rear longitudinal edge so that said track will remain fixed with respect to the shelf and will extend transversely to the front longitudinal edge of the shelf;

a tray member for carrying the display items said tray member having a front portion and an open rear portion and having means to slidably secure said tray member to said track for sliding movement of said tray member with respect to said track, and relatively towards and away from the rear longitudinal edge of the shelf upon such mounting of said track on the shelf, between a first position in which said front portion of said tray member will be generally aligned with the front longitudinal edge of the shelf and a second position in which said front portion of said tray member will extend forwardly of the front longitudinal edge of the shelf and said open rear portion of said tray will be positioned forwardly of said rear longitudinal edge of the shelf to expose therebetween a shelf portion, said open rear portion cooperating with the exposed shelf portion to form a continuous item-containing space; and locking means for releasably locking said tray member in said two positions thereof.

10. An expandable tray assembly adapted to carry items for sale or display and adapted to be supported on a generally horizontal shelf having a front and a rear longitudinal edge for increasing the effective depth of such shelf so as to allow more items to be carried thereon, comprising:

at least one track;

means for mounting said track on such a horizontal shelf having a front and a rear longitudinal edge so that said track will remain fixed with respect to the shelf and will extend transversely to the front longitudinal edge of the shelf;

a tray member for carrying the display items, said tray member having a front portion and having means to slidably secure said tray member to said track for sliding movement of said tray member with respect to said track, and relatively toward and away from the rear longitudinal edge of the shelf upon such mounting of said track on the shelf, between a first position in which said front portion of said tray member will be generally aligned with the front longitudinal edge of the shelf and a second position is which said front portion of said tray member will extend forwardly of the front longitudinal edge of the shelf, said means to slidably secure said tray member includes at least one lateral slot arranged for accommodating the at least one track; and locking means for releasably locking said tray member in said two positions thereof, said locking means including at least one lock tab secured to the tray member and extending into the lateral slot at a position above the track and a cooperating tab engagement member associated with each lock tab and attached to the track and arranged in such a way that the at least one lock tab is engageable with said tab engagement member to lock the tray member in a corresponding predetermined position with respect to the track.

11. The tray assembly of claim 10 wherein the at least one lock tab is formed of a resilient material and wherein the at least one lock tab is arranged for disengaging from the cooperating tab enegagement member by moving the lock tab away from the tab engagement member.

* * * * *